US011417487B2

(12) United States Patent
Knipe et al.

(10) Patent No.: US 11,417,487 B2
(45) Date of Patent: Aug. 16, 2022

(54) MEMS RF-SWITCH WITH NEAR-ZERO IMPACT LANDING

(71) Applicant: CAVENDISH KINETICS, INC., San Jose, CA (US)

(72) Inventors: Richard L. Knipe, McKinney, TX (US); Robertus Petrus Van Kampen, S-Hertogenbosch (NL); James Douglas Huffman, Plano, TX (US); Lance Barron, Plano, TX (US)

(73) Assignee: Qorvo US, Inc., Greensboro, NC (US)

( * ) Notice: Subject to any disclaimer, the term of this patent is extended or adjusted under 35 U.S.C. 154(b) by 572 days.

(21) Appl. No.: 16/343,912

(22) PCT Filed: Sep. 14, 2017

(86) PCT No.: PCT/US2017/051536

§ 371 (c)(1),
(2) Date: Apr. 22, 2019

(87) PCT Pub. No.: WO2018/063814

PCT Pub. Date: Apr. 5, 2018

(65) Prior Publication Data

US 2020/0185176 A1 Jun. 11, 2020

Related U.S. Application Data

(60) Provisional application No. 62/401,234, filed on Sep. 29, 2016.

(51) Int. Cl.
*H01H 59/00* (2006.01)
*H01H 1/00* (2006.01)

(52) U.S. Cl.
CPC ..... *H01H 59/0009* (2013.01); *H01H 1/0036* (2013.01); *H01H 2001/0057* (2013.01);
(Continued)

(58) Field of Classification Search
CPC ..... H01H 1/0036; H01H 2001/0057; H01H 2001/0084; H01H 2059/0072; H01H 59/0009
(Continued)

(56) References Cited

U.S. PATENT DOCUMENTS 6,608,268 B1 * 8/2003 Goldsmith ..... H01P 1/127 200/181
8,847,087 B2 * 9/2014 Naito ..... H01H 59/0009 200/181
(Continued)

FOREIGN PATENT DOCUMENTS

CN 1938807 A 3/2007
CN 101276707 A 10/2008
(Continued)

OTHER PUBLICATIONS

International Search Report and Written Opinion for PCT/US2017/051536, dated Dec. 20, 2017.
(Continued)

*Primary Examiner* — Bernard Rojas
(74) *Attorney, Agent, or Firm* — Withrow & Terranova, P.L.L.C.

(57) ABSTRACT

The present disclosure generally relates to the design of a MEMS ohmic switch which provides for a low-impact landing of the MEMS device movable plate on the RF contact and a high restoring force for breaking the contacts to improve the lifetime of the switch. The switch has at least one contact electrode disposed off-center of the switch device and also has a secondary landing post disposed near the center of the switch device. The secondary landing post extends to a greater height above the substrate as compared to the RF contact of the contact electrode so that the movable plate contacts the secondary landing post first and then gently lands on the RF contact. Upon release, the movable
(Continued)

plate will disengage from the RF contact prior to disengaging from the secondary landing post and have a longer lifetime due to the high restoring force.

14 Claims, 12 Drawing Sheets

(52) U.S. Cl.
CPC ..... *H01H 2001/0084* (2013.01); *H01H 2059/0072* (2013.01)

(58) Field of Classification Search
USPC ..... 335/78; 200/181
See application file for complete search history.

(56) References Cited

U.S. PATENT DOCUMENTS

2003/0146079 A1* 8/2003 Goldsmith ..... H01P 1/127 200/181
2005/0146241 A1* 7/2005 Wan ..... H02N 1/006 310/309
2014/0211366 A1* 7/2014 Morris, III ..... B81C 1/00166 361/277

FOREIGN PATENT DOCUMENTS

| | | | |
|---|---|---|---|
| CN | 101310206 | A | 11/2008 |
| CN | 101533740 | A | 9/2009 |
| CN | 105556635 | A | 5/2016 |
| WO | 2014025844 | A1 | 2/2014 |
| WO | 2014165624 | A1 | 10/2014 |
| WO | 2016165624 | A1 | 10/2014 |
| WO | 2016126517 | A1 | 8/2016 |

OTHER PUBLICATIONS

Intention to Grant for European Patent Application No. 17772570.2, dated Aug. 13, 2020, 36 pages.
International Preliminary Report on Patentability issued in International Patent Application No. PCT/US2017/051536, dated Apr. 2, 2019 (7 pages).
First Office Action for Chinese Patent Application No. CN201780071571.6, dated May 8, 2020, 23 pages.

* cited by examiner

MEMS RF-SWITCH WITH NEAR-ZERO IMPACT LANDING

CROSS-REFERENCE TO RELATED APPLICATIONS

This application is a national stage application under 35 U.S.C. 371 of International Application No. PCT/US2017/051536, filed Sep. 14, 2017, which claims the benefit of U.S. Patent Application No. 61/401,234 filed Sep. 29, 2016, the disclosures of which are all herein incorporated by reference in their entirety.

BACKGROUND OF THE DISCLOSURE

Field of the Disclosure

Embodiments of the present disclosure generally relate to a technique for obtaining a good controllability of the contact resistance of MEMS switches over a wide voltage operating range.

Description of the Related Art

A MEMS ohmic switch contains a movable plate that moves by applying a voltage to an actuation electrode. Electrostatic forces move the plate towards the actuation electrode. Once the electrode voltage reaches a certain voltage, oftentimes referred to as a snap-in voltage, the system becomes unstable and the plate accelerates towards the actuation electrode. The snap-in voltage is determined in part by the stiffness of the plate of the MEMS device. Having a MEMS ohmic switch operate at moderately low operating voltages, which would be desirable to allow a cheap CMOS integration of the controller, is not possible with stiff legs for the movable plate.

When the plate is actuated down, the plate lands on a contact electrode to which the plate makes an ohmic contact. To get a good ohmic contact resistance, the plate is pulled into intimate with the contact electrode by applying a high enough voltage to a pull-down electrode. The voltage can cause the plate to have an additional, secondary landing on the dielectric layer that is located above the pull-down electrode. It is a reliability concern for device operation to have the plate land on the dielectric layer. The secondary landing can lead to charging of the dielectric layer and a shift in the actuation voltage. Therefore, additional stoppers may be present to prevent the plate from landing directly on the dielectric layer above the pull-down electrode.

In a typical MEMS ohmic switch operation, the movable plate first makes contact with the contact electrode (such as an RF electrode) and subsequently comes into secondary contact with the additional stoppers. Because of the unstable nature of the snap-in behavior, the movable plate can build up sufficiently high momentum upon actuation and can hit the contact electrode with a high impact energy. The high impact energy can lead to contact wear and contact-resistance growth which limits the lifetime of the device.

Once the voltage on the control electrode is reduced sufficiently, the plate is released and ideally moves back to the original position. The release voltage is typically lower than the snap-in voltage due to the higher electrostatic forces when the plate is close to the actuation electrode and due to stiction between the plate and the contact-surfaces. In a typical MEMS ohmic switch, the stoppers are the first to disengage upon release and the contact electrodes are the last to disengage. The restoring force to pull the plate of the contact electrodes is set by the spring-constant of the plate of the MEMS ohmic switch. If the restoring force is not large enough, the plate can remain stuck down on the contact electrodes.

Therefore, there is a need in the art for a MEMS ohmic switch that does not suffer from high impact landing on the contact electrode and provides a high restoring force from the contact electrodes in order to achieve a high lifetime, while still allowing the operating voltage to be moderately low to allow for a cheap integration of the CMOS controller.

SUMMARY

The present disclosure generally relates to the design of a MEMS ohmic switch which provides for a low-impact landing of the MEMS device movable plate on the RF contact and a high restoring force for breaking the contacts to improve the lifetime of the switch. The switch has at least one contact electrode disposed off-center of the switch device and also has a secondary landing post disposed near the center of the switch device. The secondary landing post extends to a greater height above the substrate as compared to the RF contact of the contact electrode so that the movable plate contacts the secondary landing post first and then gently lands on the RF contact. Upon release, the movable plate will disengage from the RF contact prior to disengaging from the secondary landing post and have a longer lifetime due to the high restoring force.

In one embodiment, a MEMS ohmic switch 300 comprises a substrate 101 having one or more anchor electrodes 108, a plurality of pull-down electrodes 104A-104C and one or more RF electrodes 302, 304 disposed thereon; a MEMS bridge coupled to the one or more anchor electrodes 108 with an anchor contact layer 208; a dielectric layer 202 disposed over the one or more pull-down electrodes 104A-104C; a center stopper 314 coupled to the dielectric layer 202 and disposed under a substantially center of the MEMS bridge; an RF contact 306 coupled to an RF electrode 302 of the one or more RF electrodes 302, 304; and an additional stopper 310 disposed on the dielectric layer 202, wherein the additional stopper 310 is disposed between the anchor contact layer 208 and the RF contact 306 and wherein the RF contact 306 is disposed between the additional stopper 310 and the center stopper 314.

A method of operating the MEMS ohmic switch 300 comprises: applying a voltage to one or more of the plurality of pull-down electrodes 104A-104C; moving the MEMS bridge a first distance to contact the center stopper 314; moving the MEMS bridge a second distance to contact the additional stopper 310; and moving the MEMS bridge a third distance to contact the RF contact 306.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally relates to the design of a MEMS ohmic switch which provides for a low-impact landing of the MEMS device movable plate on the RF contact and a high restoring force for breaking the contacts to improve the lifetime of the switch. The switch has at least one contact electrode disposed off-center of the switch device and also has a secondary landing post disposed near the center of the switch device. The secondary landing post extends to a greater height above the substrate as compared to the RF contact of the contact electrode so that the movable plate contacts the secondary landing post first and then gently lands on the RF contact. Upon release, the movable plate will disengage from the RF contact prior to disengaging from the secondary landing post and have a longer lifetime due to the high restoring force.

Figure 1A:
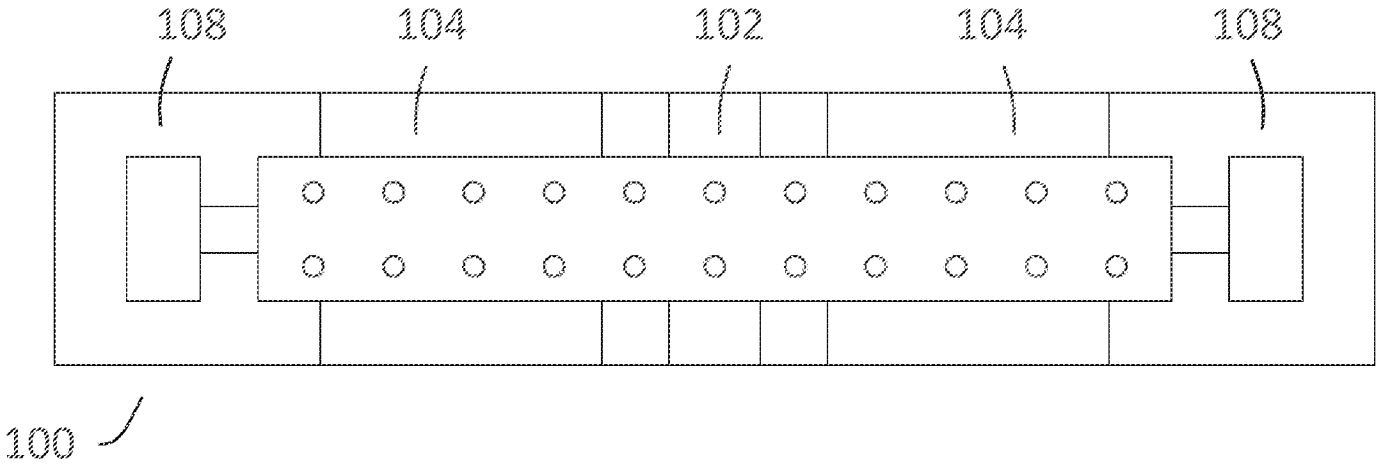
FIG. 1A is a schematic top-view of an MEMS ohmic switch.

FIG. 1A is a schematic top-view of a MEMS ohmic switch 100. The ohmic switch 100 comprises an RF electrode 102, pull-down electrodes 104 and anchor electrodes 108. In operation, when a sufficiently high voltage is applied to the pull-down electrodes 104, the MEMS ohmic switch 100 is actuated down towards the RF electrode 102 and forms an ohmic connection between the RF electrode 102 and anchor electrodes 108.

Figure 1B:
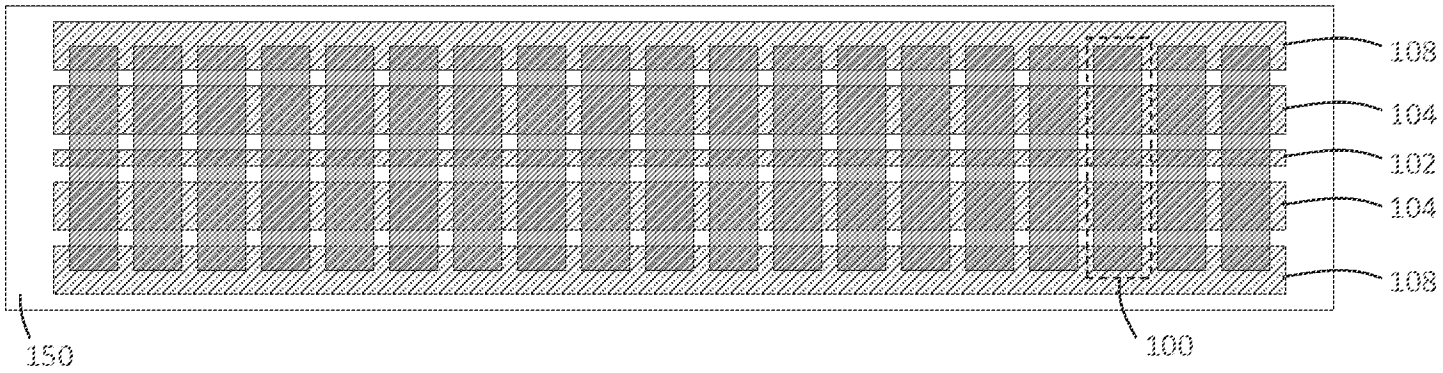
FIG. 1B is a schematic top view of an MEMS ohmic switch cell containing a number of parallel operated MEMS ohmic switches.

FIG. 1B is a schematic top view of an ohmic switch cell 150 containing a number of MEMS ohmic switches 100. All MEMS switches 100 in the cell 150 are turned on at the same time by applying a sufficiently high voltage to the pull-down electrodes 104. Because many switches 100 are operated in parallel, the resistance between the RF electrode 102 and anchor electrodes 108 is reduced.

Figure 1C:
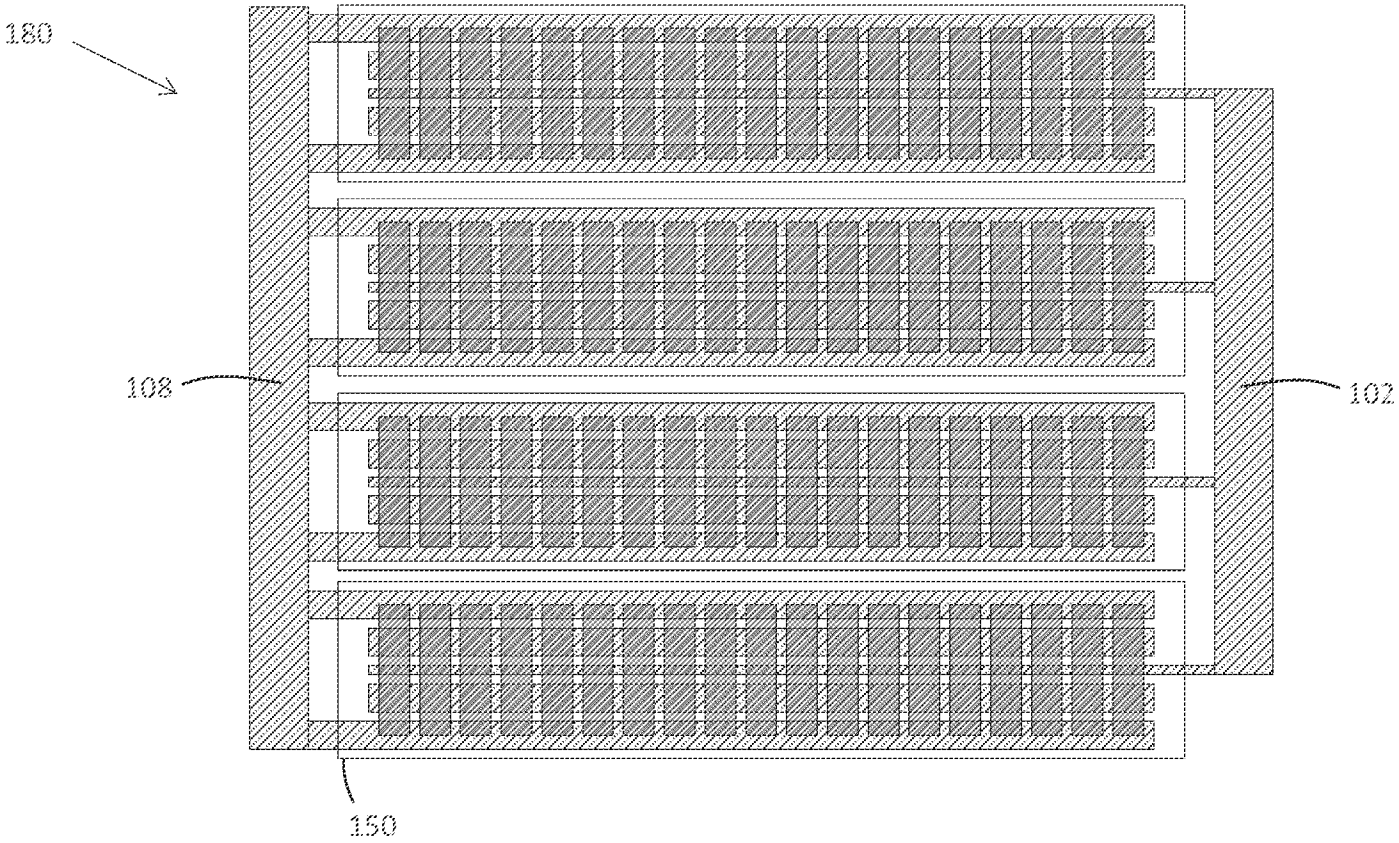
FIG. 1C is a schematic top view of a MEMS ohmic switch cell array containing a number of parallel operated MEMS ohmic switch cells.

FIG. 1C shows a schematic top-view of a MEMS ohmic switch cell array 180. The array 180 contains a number of parallel operated MEMS ohmic switch cells 150. The RF electrodes 102 of each cell 150 are connected together at one end of each switch cell 150, while the anchor-electrodes 108 are connected together at the other end of each switch cell 150. When all cells 150 are turned on, a further reduction of the resistance between the RF-electrode 102 and anchor electrode 108 occurs when compared to a single cell 150. At the same time, because many switches 100 are operated in parallel, the array 180 can handle more current compared to a single cell 150.

Figure 2A:
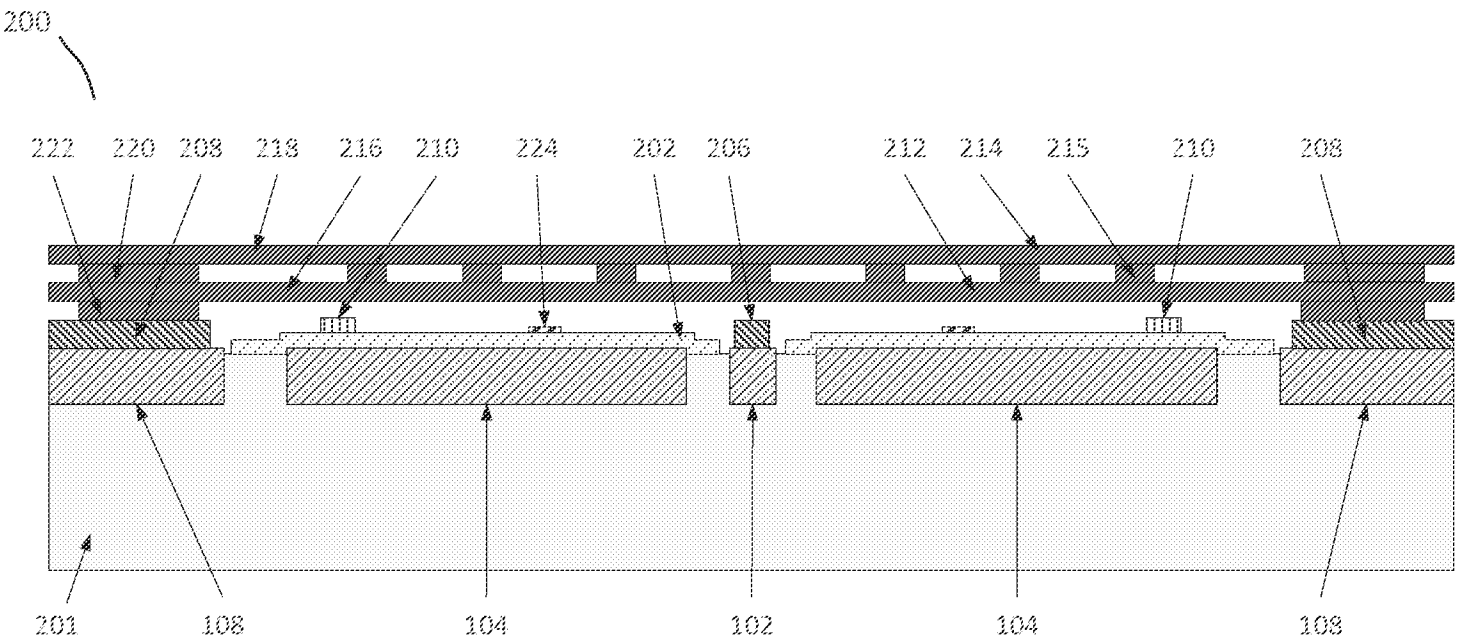
FIG. 2A is a schematic cross-sectional view of a MEMS ohmic switch.

FIG. 2A shows a cross-section view of MEMS ohmic switch 200. The MEMS ohmic switch 200 comprises an RF electrode 102, pull-down electrodes 104 and anchor electrodes 108 located on a substrate 201. The pull-down electrodes 104 are covered with a dielectric layer 202 to avoid a short-circuit between the MEMS ohmic switch movable plate and the pull-down electrode 104 in the pulled-down state. Suitable materials for the dielectric layer 202 include silicon based materials including silicon-oxide, silicon-dioxide, silicon-nitride and silicon-oxynitride. The thickness of the dielectric layer 202 is typically in the range of 50 nm to 150 nm to limit the electric field in the dielectric layer 202. On top of the RF electrode 102, is the RF contact 206 to which the movable plate forms an ohmic contact in the pulled-down state. On top of the anchor electrodes 108 are the anchor contacts 208 to which the movable plate (oftentimes referred to as the MEMS device) is anchored. Suitable materials used for the contacts 206, 208 include Ti, TiN, TiAl, TiAlN, AlN, Al, W, Pt, Ir, Rh, Ru, $RuO_2$, ITO and Mo and combinations thereof.

Additional stoppers 210 are located between the anchor contacts 208 and the RF contact 206. More stoppers 224 are located between the stoppers 210 and RF contact 206. Suitable materials that may be used for the stoppers 210, 224 include Ti, TiN, TiAl, TiAlN, AlN, Al, W, Pt, Ir, Rh, Ru, $RuO_2$, ITO, Mo and silicon based materials such as silicon-oxide, silicon-dioxide, silicon-nitride and silicon-oxynitride and combinations thereof.

The movable plate or switching element contains a stiff bridge consisting of conductive layers 212, 214 which are joined together using an array of vias 215. The conductive layers 212, 214 and vias 215 allows for a stiff plate-section and compliant legs to provide a high contact force while keeping the operating voltage to acceptable levels. The MEMS bridge is suspended by legs 216 formed in the lower conductive layer 212 and legs 218 formed in the upper conductive layer 214 of the MEMS bridge. The upper conductive layer 214 of the MEMS bridge is anchored to the lower layer 212 of the MEMS bridge in the anchor with via 220. The lower conductive layer 212 of the MEMS bridge is anchored to the anchor contact 208 with via 222. Because these legs 216, 218 are not joined together with vias 215 like in the MEMS bridge, the compliance of these legs 216, 218 is still low enough to allow for reasonable operating voltages (e.g. 25V to 40V) to pull the MEMS bridge in contact with the RF contact 206 and stoppers 210, 224, which allows for a cheap integration of the CMOS controller with a charge-pump to generate the voltages to drive the MEMS device.

Current that is injected from the RF contact 206 into the MEMS bridge when the MEMS ohmic switch is actuated down flows out through the MEMS bridge and legs 216, 218 in both directions to the anchor electrodes 108 located on either side of the switch-body.

Figure 2B:
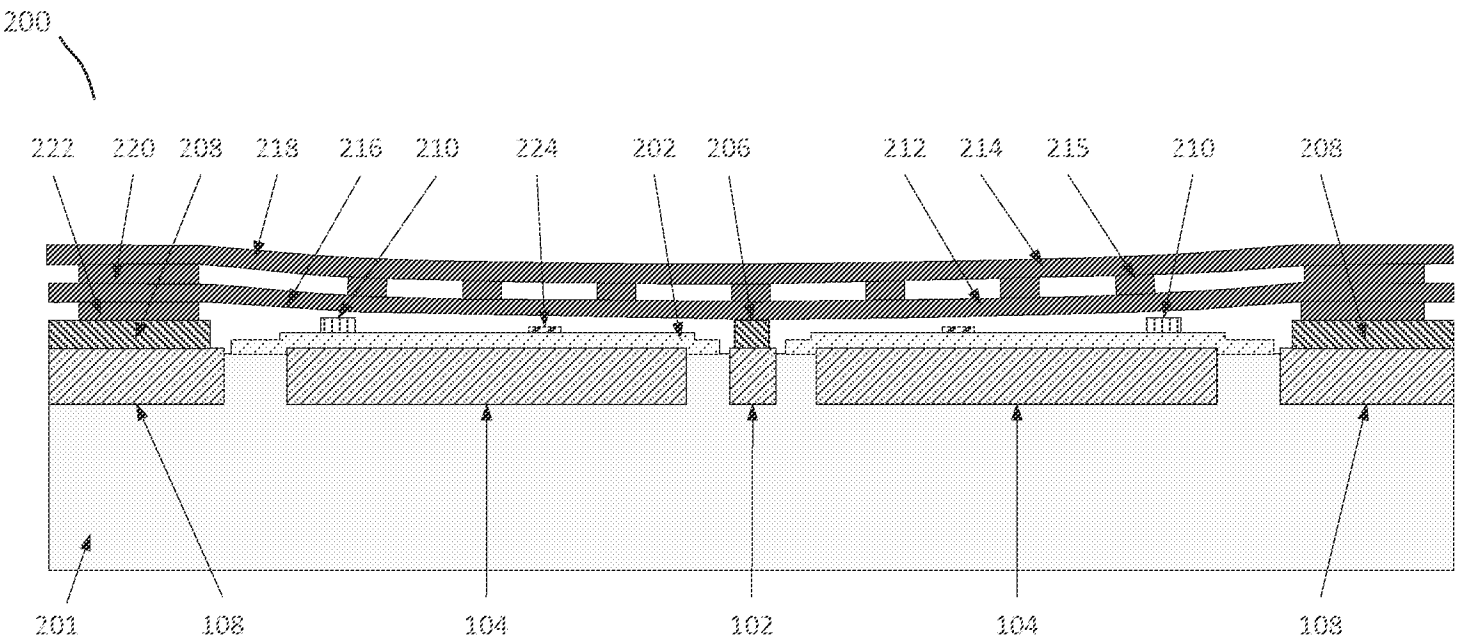
FIG. 2B is a schematic cross-sectional view of the MEMS ohmic switch of FIG. 2A which is being actuated down and hits the contact-electrode.

FIG. 2B shows the MEMS ohmic switch 200 as it is being actuated downwards during the dynamic snap-in. Because of the unstable nature of the snap-in behavior, the MEMS bridge comes into contact with the RF contact 206 with a high impact which can create contact wear.

Figure 2C:
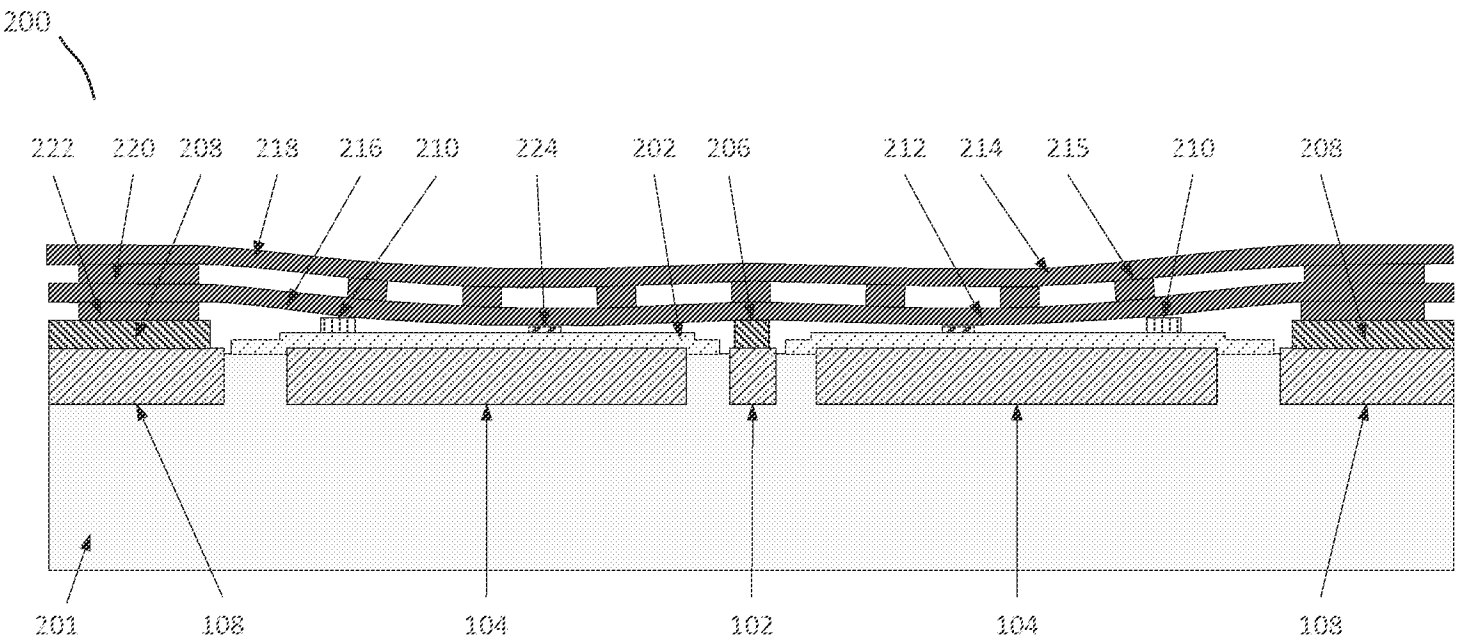
FIG. 2C is a schematic cross-sectional view of the MEMS ohmic switch of FIG. 2B which is actuated down in the final state on the contact electrode and additional stoppers.

FIG. 2C shows the MEMS ohmic switch 200 as in the final actuated downwards state. The MEMS bridge is in contact with the RF contact 206 and additional stoppers 210, 224. If the height of the stoppers 210 is sufficiently high, the MEMS device may not touch stopper 224. The stoppers 224 then act as fail-safe stoppers to prevent the MEMS bridge from landing on the dielectric layer 202 above the pull-down electrode 104, which could lead to charging of the dielectric layer 202 and a failure to operate the device.

When the voltage on the pull-down electrodes 104 is reduced, the stoppers 210, 224 are the first to disengage from the MEMS bridge, and the device will then be in the state shown in FIG. 2B. The RF contact 206 is the last to disengage from the MEMS bridge before the device returns to the freestanding state shown in FIG. 2A. The pull-off force from the RF contacts 206 is set by the stiffness of the legs 216, 218. Since the legs 216, 218 are designed for limited operating voltages of 25V to 40V, the restoring force of the legs 216, 218 is limited and the MEMS device could remain stuck down on the RF contacts 206 leading to a device failure.

Figure 3A:
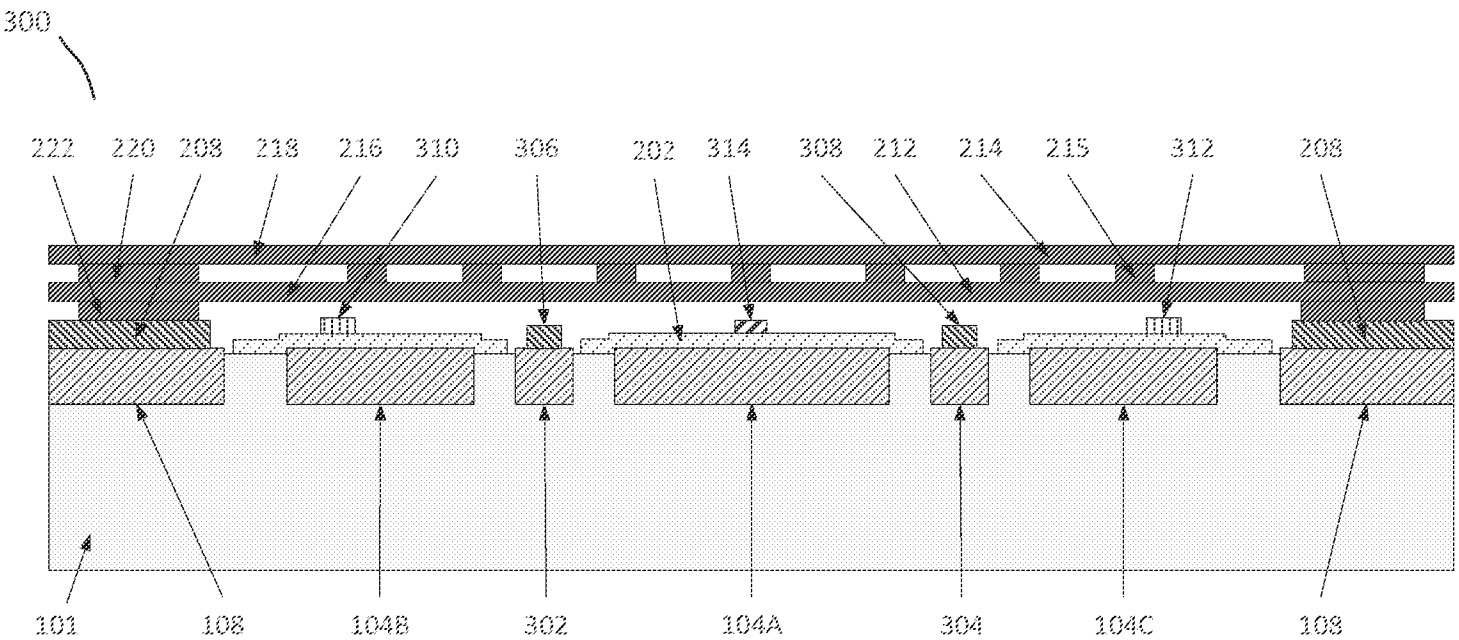
FIG. 3A is a schematic cross-sectional view of a MEMS ohmic switch according to one embodiment.

FIG. 3A shows a cross-section view of a MEMS ohmic switch 300 according to one embodiment. The switch operates with near-zero impact force on the RF contact and has a high restoring force to break the contact when releasing the movable plate while still operating the switch 300 at limited operating voltages of 25V to 40V.

The switch 300 contains RF electrodes 302, 304, pull-down electrodes 104A-104C and anchor electrodes 108 located on substrate 101. The RF electrodes 302, 304 are each disposed between two pull-down electrodes 104. Specifically, RF electrode 302 is disposed between a center pull-down electrode 104A and an edge pull-down electrode 104B. Similarly, RF electrode 304 is disposed between the center pull-down electrode 104A and another edge pull-down electrode 104C. The pull-down electrodes 104A-104C are covered with a dielectric layer 202 to avoid a short-circuit between the MEMS switch and the pull-down electrodes 104A-104C in the pulled-down state. Suitable materials for the dielectric layer 202 include silicon based materials including silicon-oxide, silicon-dioxide, silicon-nitride and silicon-oxynitride. The thickness of the dielectric layer 202 is within the range of 50 nm to 150 nm to limit the electric field in the dielectric layer 202. On top of RF electrode 302 is RF contact 306, and on top of RF electrode 304 is RF contact 308. In the final pulled-down state shown in FIG. 3D, the switch body forms an ohmic contact to both RF contacts 306, 308. On top of the anchor electrode 108 is the anchor contact 208 to which the MEMS device is anchored. Suitable materials used for the contacts 306, 308, 208 include Ti, TiN, TiAl, TiAlN, AlN, Al, W, Pt, Ir, Rh, Ru, $RuO_2$, ITO and Mo and combinations thereof.

A center stopper 314 is located near the center of the switch between RF contacts 306, 308 and under the substantial center of the MEMS bridge. The center stopper 314 extends above the substrate 101 by a greater distance than the RF contacts 306, 308 so that upon actuation, the MEMS bridge comes into contact with center stopper 314 first. In one embodiment, the center stopper 314 extends above the substrate 101 by a distance that is equal to the RF contacts 306, 308. Additional stoppers 310, 312 are disposed between the RF contacts 306, 308 and the anchor contact 208. Specifically, stopper 310 is disposed between an anchor contact 208 and RF contact 306. Stopper 312 is disposed between an anchor contact 208 and RF contact 308. The stoppers 310, 312 extend above the substrate 101 by a greater distance than the RF contacts 306, 308 so that upon actuation the MEMS bridge comes into contact with the stoppers 310, 312 before coming into contacts RF contact 306, 308. The stoppers 310, 312 also extend above the substrate 101 by a distance greater than the center stopper 314 due to the bending of the MEMS bridge as the MEMS bridge is being actuated downwards. Suitable materials that may be used for the stoppers 310, 312, 314 include silicon based materials including silicon-oxide, silicon-dioxide, silicon-nitride and silicon-oxynitride and combinations thereof.

The switch element contains a stiff bridge consisting of conductive layers 212, 214 which are joined together using an array of vias 215. The conductive layers 212, 214 and vias 215 allow for a stiff plate-section and compliant legs to provide a high contact-force while keeping the operating voltage to acceptable levels. The MEMS bridge is suspended by legs 216 formed in the lower conductive layer 212 and legs 218 formed in the upper conductive layer 214 of the MEMS bridge. The upper conductive layer 214 of the MEMS bridge is anchored to the lower conductive layer 212 in the anchor with via 220. The lower conductive layer 212 of the MEMS bridge is anchored to the anchor contact 208 with via 222. Because the legs 216, 218 are not joined together with vias 215 like in the MEMS-bridge the compliance of these legs is still low enough to allow for reasonable operating voltages to pull the MEMS bridge in contact with the RF contacts 306, 308 and stoppers 310, 312,314.

Current that is injected from the RF contact 306 into the MEMS bridge when the MEMS switch is actuated down flows out through the MEMS bridge and RF contact 308. The thicknesses of RF contacts 306, 308 and stoppers 310, 312, 314 is set such that stoppers 314 are engaged first upon pulldown actuation, followed by stoppers 310, 312 and finally RF contacts 306, 308.

Figure 3B:
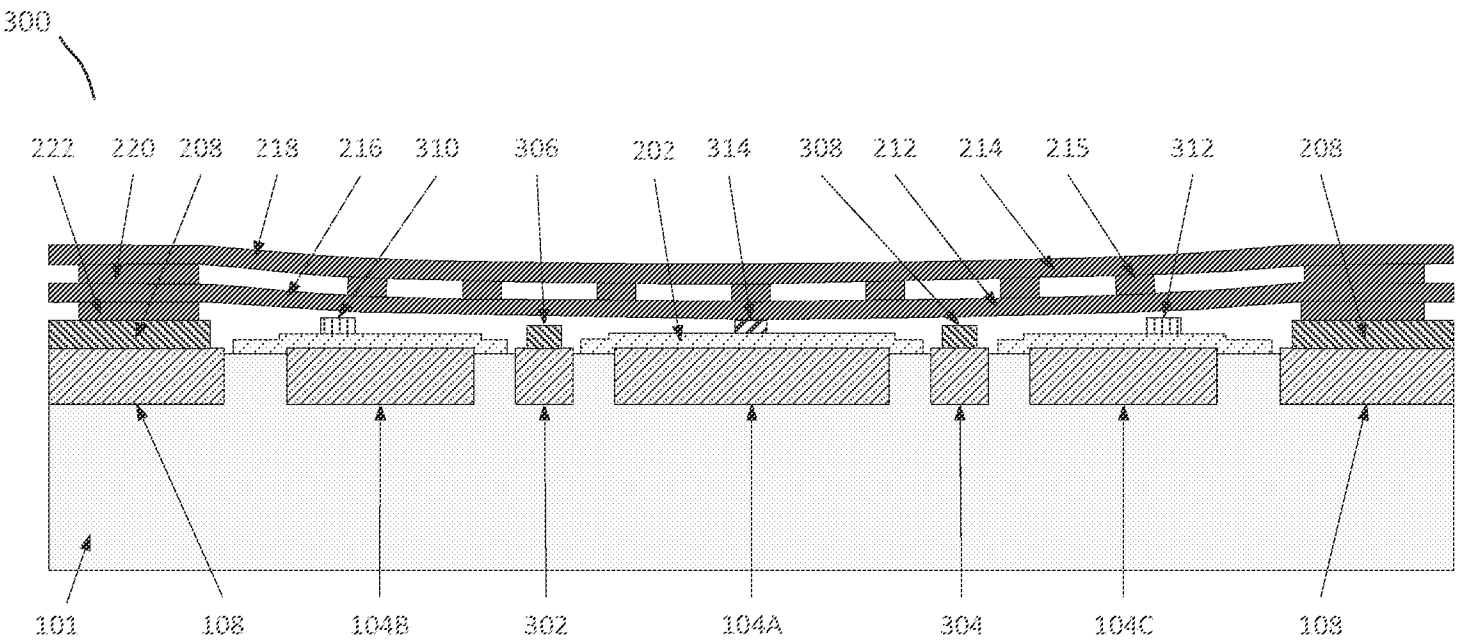
FIG. 3B is a schematic cross-sectional view of the MEMS ohmic switch of FIG. 3A which is actuated down on the center stopper.

FIG. 3B shows the MEMS ohmic switch 300 being actuated downwards during the dynamic snap-in. Because of the unstable nature of the snap-in behavior the MEMS bridge comes in contact with the stopper 314 with a high impact. The stopper 314 comprises a dielectric material and thus, the dielectric interface can sustain repeated impacts without damage. Note that in the position shown in FIG. 3B, the MEMS bridge is still spaced from stoppers 310, 312 and RF contacts 306, 308. For the MEMS ohmic switch 300 to be moved from the position shown in FIG. 3A to the position shown in FIG. 3B, a voltage is applied to one or more of the pull-in electrodes 104A-104C and the MEMS bridge is moved a first distance such that the MEMS bridge contacts stopper 314, but remains spaced from stoppers 310, 312 and RF contacts 306, 308.

Figure 3C:
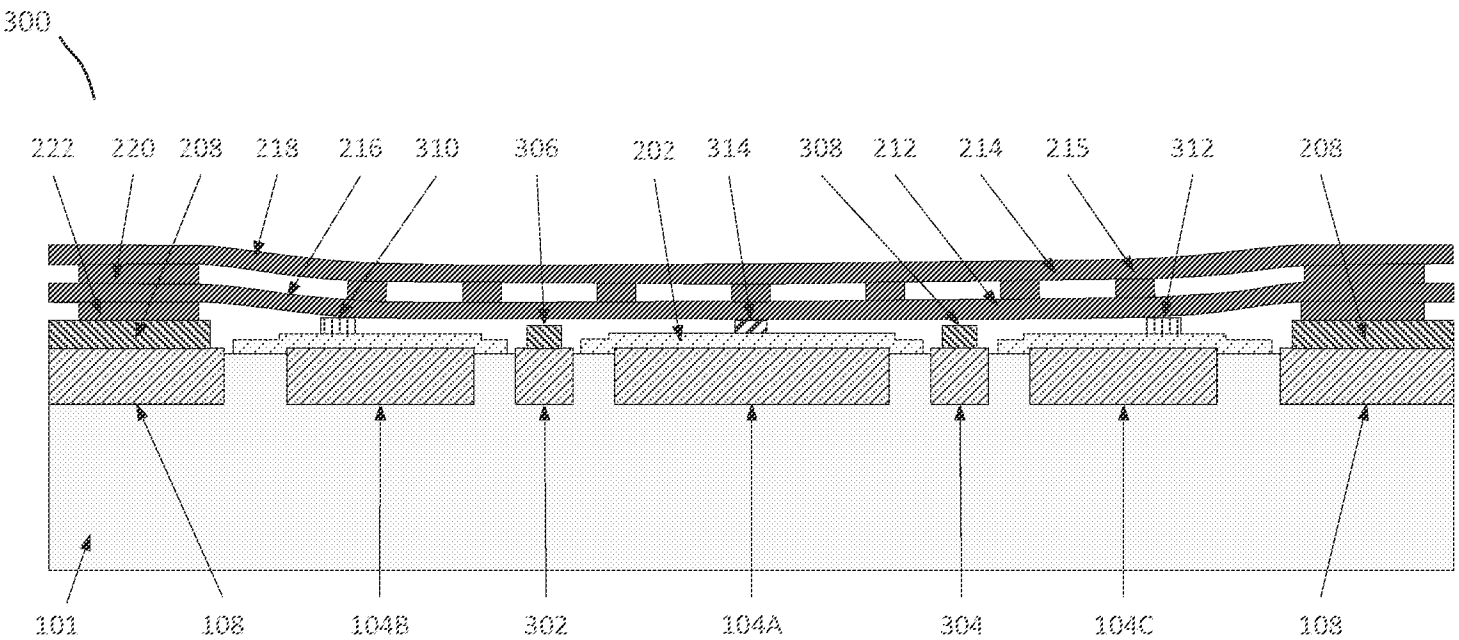
FIG. 3C is a schematic cross-sectional view of the MEMS ohmic switch of FIG. 3B which is actuated down on the center-stopper and the back-stoppers.

FIG. 3C shows the MEMS ohmic switch 300 a moment in time later after landing on the stoppers 310, 312. At this point, the stiff MEMS bridge is not in contact with the RF contacts 306, 308, because a larger electrostatic force is required to bend the stiff MEMS bridge any further. As the voltage on the pull-down electrodes 104A-104C is ramped up to the final operating value, the MEMS bridge slowly flexes between stoppers 310, 312 and 314 until finally hitting the RF contacts 306, 308. For the MEMS ohmic switch 300 to be moved from the position shown in FIG. 3B to the position shown in FIG. 3C, additional voltage (or simply continuation of the voltage applied to move the MEMS bridge to the position shown in FIG. 3B) is applied to one or more of the pull-in electrodes 104A-104C and the MEMS bridge is moved a second distance such that the MEMS bridge contacts stoppers 314, 310, 312, but remains spaced from the RF contacts 306, 308.

Figure 3D:
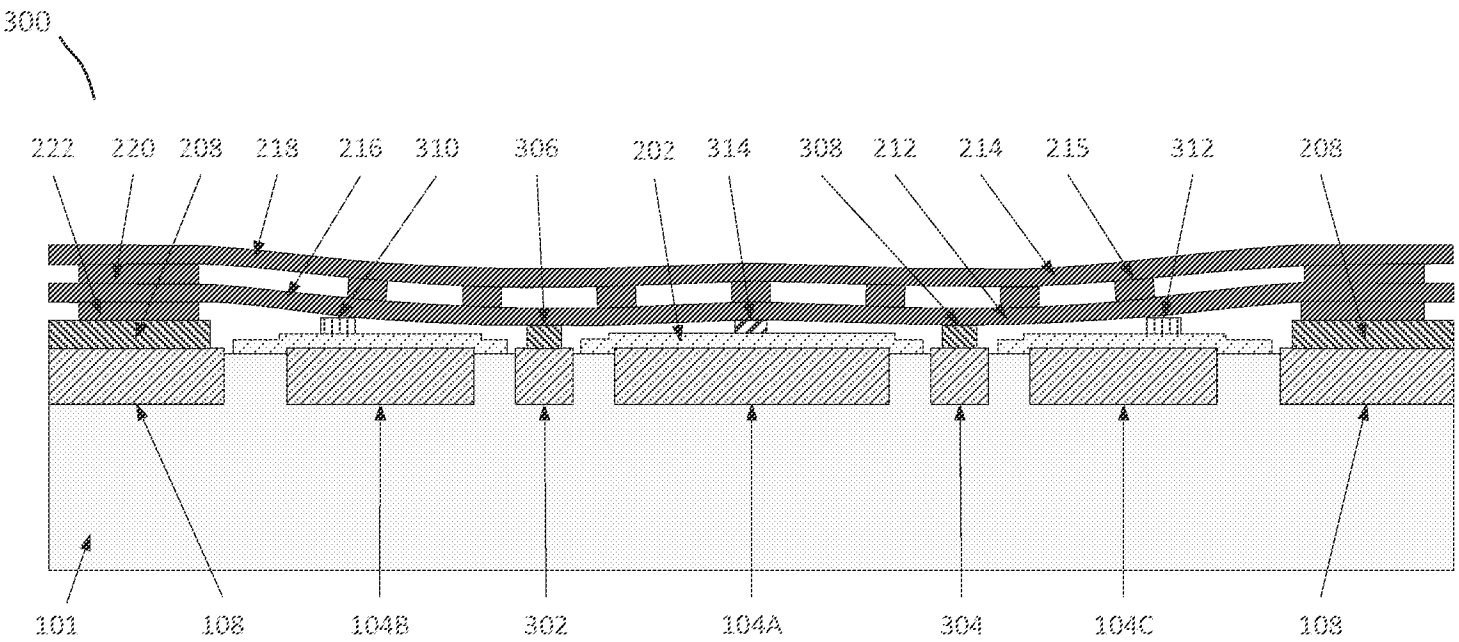
FIG. 3D is a schematic cross-sectional view of the MEMS ohmic switch of FIG. 3C which is actuated down in the final state on the contact-electrode, center-stopper and back-stoppers.

FIG. 3D shows the MEMS ohmic device in the final state after the voltage on the pull-down electrodes 104A-104C has ramped up to the final operating value. If the height above the substrate 101 of the RF contacts 306, 308 is set too low, the MEMS bridge will show a secondary snap-in behavior from the initial touchdown on stoppers 310, 312, 314 to the final state when the MEMS bridge also lands on RF contacts 306, 308. The impact of the final landing on the RF contacts 306, 308 is greatly reduced from the initial impact on the center-stopper 314 because the travel distance from the device state in FIG. 3C to the device state in FIG. 3D is very limited. If the RF contacts 306, 308 are set high enough, the touchdown of the MEMS bridge on the RF contacts can be gentle and not show a secondary snap-in behavior. The impact in such a case is set by the ramp-rate of the voltage on the pull-down electrodes 104A-104C. In this way, the impact of the MEMS bridge on the RF-contacts 306, 308 can be limited, which improves the wear of the contact surfaces. For the MEMS ohmic switch 300 to be moved from the position shown in FIG. 3C to the position shown in FIG. 3D, additional voltage (or simply continuation of the voltage applied to move the MEMS bridge to the position shown in FIG. 3C) is applied to one or more of the pull-in electrodes 104A-104C and the MEMS bridge is moved a second distance such that the MEMS bridge contacts stoppers 314, 310, 312 and RF contacts 306, 308.

When the voltage on the pull-down electrode 104A-104C is ramped down upon release of the MEMS bridge, the RF contacts 306, 308 are the first to disengage from the MEMS bridge, because the MEMS bridge, which is naturally stiff, is flexed between stoppers 310, 312 and 314 has a high restoring force. The high restoring force provides for a robust way to break the ohmic contact. As the voltage on the pull-down electrodes 104A-104C continues to ramp down, subsequently the stoppers 310, 312 and 314 are disengaged from the MEMS bridge returning the device to the free-standing state of FIG. 3A.

During operation, the heights above the substrate 101 for the RF contact 306, center stopper 314 and additional stoppers 310, 312 are set such that upon increasing a voltage on a pull-down electrode 104A-104C, the MEMS bridge first comes into contact with the center stopper 314, then the additional stoppers 310, 312 and then the RF contacts 306, 308 and wherein upon decreasing the voltage to the pull-down electrode 104A-104C, the MEMS bridge first disengages the RF contacts 306, 308 and then the additional stoppers 310, 312. Furthermore, a height above the substrate 101 for the RF contacts 306, 308 is set such that upon increasing voltage applied to a pull-down electrode 104A-104C, the MEMS bridge lands on the RF contacts 306, 308 without showing a snap-in behavior.

Figure 4A:
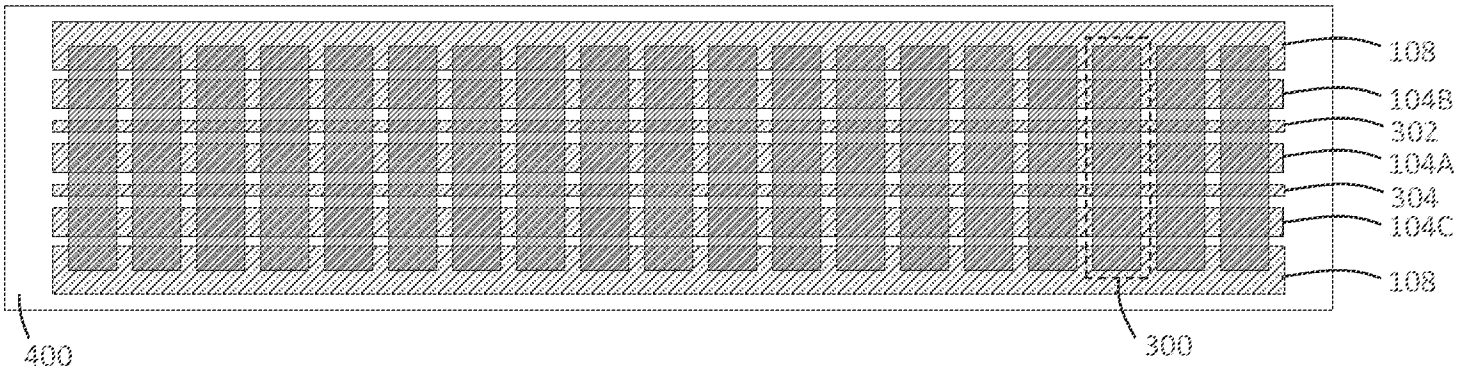
FIG. 4A is a schematic top view of a MEMS ohmic switch cell according to one embodiment containing a number of parallel operated improved MEMS switches.

FIG. 4A is a schematic top view of a MEMS ohmic switch cell 400 containing a number of MEMS ohmic switches 300. All MEMS switches 300 in the cell 400 are turned on at the same time by applying a high-enough voltage on the pull-down electrodes 104A-104C. Because many switches 300 are operated in parallel, the resistance between the RF-electrode 302 and anchor electrodes 108 is reduced.

Figure 4B:
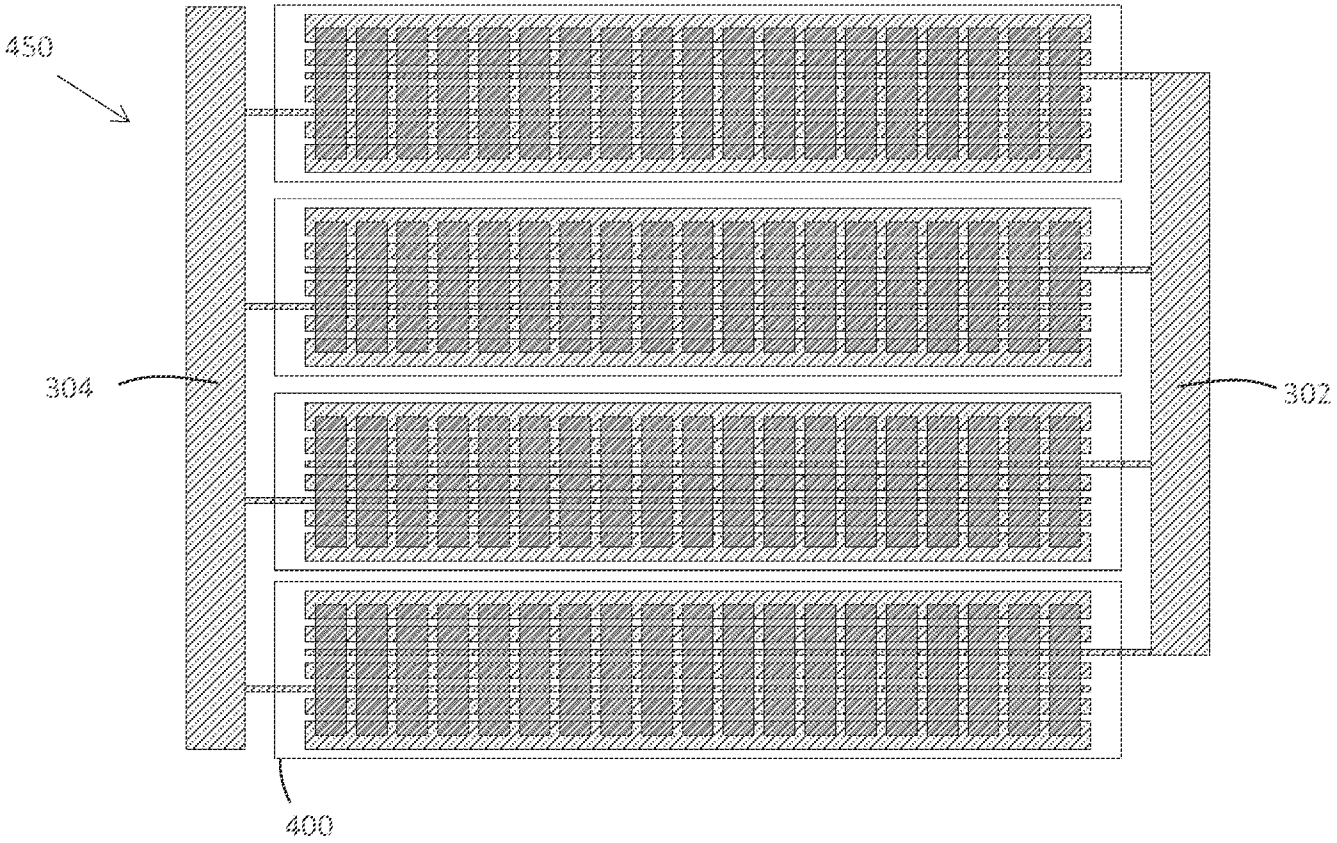
FIG. 4B is a schematic top view of a MEMS ohmic switch cell array containing a number of parallel operated MEMS ohmic switch cells.

FIG. 4B shows a schematic top-view of a MEMS ohmic switch cell array 450. The array 450 contains a number of parallel operated switch cells 400. The RF-electrodes 302 of each cell are connected together at one end of each switch cell 400, while the RF-electrodes 304 are connected together at the other end of each switch cell 400. When all cells 400 are turned on, a further reduction of the resistance between the RF-electrode 302 and the anchor electrode 108 occurs. At the same time, because many switches 300 are operated in parallel, the total switch array 450 can handle more current.

By ensuring the MEMS bridge lands on secondary contacts prior to landing on the RF contact, impact damage to the RF contact is reduced. Additionally, such an arrangement ensures the MEMS bridge has a higher restoring force.

While the foregoing is directed to embodiments of the present disclosure, other and further embodiments of the disclosure may be devised without departing from the basic scope thereof, and the scope thereof is determined by the claims that follow.

What is claimed is:

1. A MEMS ohmic switch (300), comprising:

a substrate (101) having one or more anchor electrodes (108), a plurality of pull-down electrodes (104A-104C), a first RF electrode (302), and a second RF electrode (304) disposed thereon;

a MEMS bridge coupled to the one or more anchor electrodes (108) with an anchor contact layer (208);

a dielectric layer (202) disposed over the plurality of pull-down electrodes (104A-104C);

a center stopper (314) coupled to the dielectric layer (202) and disposed under a substantially center of the MEMS bridge, wherein the center stopper (314) is disposed between the first RF electrode (302) and the second RF electrode (304);

a first RF contact (306) coupled to the first RF electrode (302) and a second RF contact (308) coupled to the second RF electrode (304); and a first additional stopper (310) disposed on the dielectric layer (202), wherein the first additional stopper (310) is disposed between the anchor contact layer (208) and the first RF contact (306) and wherein the first RF contact (306) is disposed between the first additional stopper (310) and the center stopper (314).

2. The MEMS ohmic switch (300) of claim 1, wherein the MEMS bridge is stiff between the center stopper (314) and the first additional stopper (310).

3. The MEMS ohmic switch (300) of claim 1, wherein the center stopper (314) extends above the substrate (101) by a distance that is equal to or greater than a distance the first RF contact (306) extends above the substrate (101).

4. The MEMS ohmic switch (300) of claim 1, wherein the first additional stopper (310) extends above the substrate (101) by a distance that is greater than a distance the first RF contact (306) extends above the substrate (101).

5. The MEMS ohmic switch (300) of claim 1, wherein the second RF contact (308) is disposed between the center stopper (314) and an additional anchor contact layer (208).

6. The MEMS ohmic switch (300) of claim 5, wherein the second additional stopper (312) is disposed between the anchor contact layer (208) and the center stopper (314).

7. The MEMS ohmic switch (300) of claim 1, further comprising a second additional stopper (312) disposed on the dielectric layer (202).

8. The MEMS ohmic switch (300) of claim 1, wherein heights above the substrate (101) for the first RF contact (306), center stopper (314) and the first additional stopper (310) are set such that upon increasing a voltage on one of the plurality of pull-down electrodes (104A-104C), the MEMS bridge first comes into contact with the center stopper (314), then the first additional stopper (310) and then the first RF contact (306) and wherein upon decreasing the voltage to the one of the plurality of pull-down electrodes (104A-104C), the MEMS bridge first disengages the first RF contact (306).

9. The MEMS ohmic switch (300) of claim 1, wherein a height above the substrate (101) for the first RF contact (306) is set such that upon increasing a voltage applied to one of the plurality of pull-down electrodes (104A-104C), the MEMS bridge lands on the first RF contact (306) without showing a snap-in behavior.

10. A method of operating a MEMS ohmic switch (300), wherein the switch (300) includes:

a substrate (101) having one or more anchor electrodes (108), a plurality of pull-down electrodes (104A-104C), a first RF electrode (302), and a second RF electrode (304) disposed thereon;

a MEMS bridge coupled to the one or more anchor electrodes (108) with an anchor contact layer (208);

a dielectric layer (202) disposed over the plurality of pull-down electrodes (104A-104C);

a center stopper (314) coupled to the dielectric layer (202) and disposed under a substantial center of the MEMS bridge, wherein the center stopper (314) is disposed between the first RF electrode (302) and the second RF electrode (304);

a first RF contact (306) coupled to the first RF electrode (302) and a second RF contact (308) coupled to the second RF electrode (304); and an additional stopper (310) disposed on the dielectric layer (202), wherein the additional stopper (310) is disposed between the anchor contact layer (208) and the first RF contact (306) and wherein the first RF contact (306) is disposed between the additional stopper (310) and the center stopper (314), the method comprising:

moving the MEMS bridge a first distance to contact the center stopper (314) by applying a voltage to one or more of the plurality of pull-down electrodes (104A-104C);

moving the MEMS bridge a second distance to contact the additional stopper (310) by continuing the voltage or by applying a first additional voltage to one or more of the plurality of pull-down electrodes (104A-104C); and moving the MEMS bridge a third distance to contact the RF contact (306) by continuing the voltage or by applying a second additional voltage to one or more of the plurality of pull-down electrodes (104A-104C).

11. The method of claim 10, wherein once the MEMS bridge has moved the first distance, but before the MEMS bridge has moved the second distance, the MEMS bridge is spaced from the first RF contact (306) and the additional stopper (310).

12. The method of claim 10, wherein once the MEMS bridge has moved the second distance, but before the MEMS bridge has moved the third distance, the MEMS bridge is spaced from the first RF contact (306).

13. The method of claim 10, wherein once the MEMS bridge has moved the second distance, the MEMS bridge remains in contact with the center stopper (314).

14. The method of claim 10, wherein once the MEMS bridge has moved the third distance, the MEMS bridge remains in contact with the center stopper (314) and the additional stopper (310).

* * * * *